US009287637B2

(12) United States Patent
Therrien

(10) Patent No.: US 9,287,637 B2
(45) Date of Patent: Mar. 15, 2016

(54) SPLIT BOLT ELECTRICAL CONNECTOR ASSEMBLY

(71) Applicant: Hubbell Incorporated, Shelton, CT (US)

(72) Inventor: Peter N. Therrien, Bedford, NH (US)

(73) Assignee: Hubbell Incorporated, Shelton, CT (US)

( * ) Notice: Subject to any disclaimer, the term of this patent is extended or adjusted under 35 U.S.C. 154(b) by 113 days.

(21) Appl. No.: 13/627,081

(22) Filed: Sep. 26, 2012

(65) Prior Publication Data

US 2014/0087598 A1 Mar. 27, 2014

(51) Int. Cl.
*H01R 4/32* (2006.01)
*H01R 4/38* (2006.01)

(52) U.S. Cl.
CPC ... *H01R 4/32* (2013.01); *H01R 4/38* (2013.01)

(58) Field of Classification Search
CPC ..... H01R 4/32; H01R 4/36; H01R 4/22; H01R 4/70; H01R 13/53; H01R 13/5216; H01R 9/24; H01R 4/646; H01R 4/66
USPC ..... 439/777, 779, 908
See application file for complete search history.

(56) References Cited

U.S. PATENT DOCUMENTS 2,218,210 A 10/1939 Mebold
2,206,295 A * 7/1940 Ziemer ..... 439/779
2,267,523 A 12/1941 Haversat
2,290,691 A * 7/1942 Lemont ..... 439/779
2,731,616 A 1/1956 Pavelka
3,260,987 A 7/1966 Gunthel, Jr.
3,298,072 A 1/1967 Whalen
3,358,263 A * 12/1967 Reeves ..... 439/199
4,147,446 A * 4/1979 Frank, Jr. ..... 403/390
4,831,902 A 5/1989 McClure
4,923,319 A 5/1990 Dent
5,129,844 A 7/1992 Goto
5,236,377 A * 8/1993 Goto ..... 439/779
5,597,314 A 1/1997 Auclair et al.
5,823,804 A * 10/1998 Auclair ..... 439/98
7,044,426 B1 5/2006 Allmon et al.
7,566,250 B1 * 7/2009 Good ..... 439/779
7,607,878 B2 10/2009 Whipple et al.
7,708,234 B2 * 5/2010 Kossak ..... 248/49
7,798,869 B1 * 9/2010 Konopacki et al. ..... 439/812
7,963,811 B2 * 6/2011 Wason et al. ..... 439/798
7,967,972 B2 * 6/2011 Glass et al. ..... 205/734
8,277,263 B1 * 10/2012 Smith ..... 439/779
8,382,535 B2 * 2/2013 Werthman et al. ..... 439/883

* cited by examiner

*Primary Examiner* — Briggitte R Hammond
(74) *Attorney, Agent, or Firm* — Dickinson Wright PLLC

(57) ABSTRACT

An electrical connector includes a split bolt having a base and first and second outwardly extending legs. A conductor receiving channel is formed between the legs. A nut threadably engages the legs and has upper and lower surfaces and an opening through it. A pressure bar member is movably received in the conductor receiving channel. A head of the pressure bar member contacts the lower surface of the nut and a body of the pressure bar member extends through the opening in the nut. A spacer is disposed in the conductor receiving channel between the base and the head of the pressure bar member.

17 Claims, 7 Drawing Sheets

SPLIT BOLT ELECTRICAL CONNECTOR ASSEMBLY

FIELD OF THE INVENTION

The present invention relates generally to a split bolt electrical connector assembly. More particularly, the present invention relates to a split bolt electrical connector assembly having a threaded post for connecting to a support. Still more particularly, the present invention relates to a split bolt electrical connector assembly including a spacer having a connecting portion that is removable.

BACKGROUND OF THE INVENTION

Split bolt electrical connectors are conventionally used to electrically and mechanically connect two conductors, such as a tap conductor and a main conductor. However, conventional split bolt electrical connectors are limited to such use. Accordingly, a need exists for a multi-purpose split bolt electrical connector assembly.

Nuts are typically threadably connected to conventional split bolt electrical connectors to axially move pressure bar members into engagement with inserted conductors. Those pressure bar members are not lockingly connected to the nut such that when the nuts loosen over time, the pressure bar members can become separated from the split bolt electrical connectors. Additionally, the pressure bar members must be held in place by the user in the split bolt while threadably engaging the nuts, thereby increasing the difficulty of installation. Accordingly, a need exists for a split bolt electrical connector assembly in which a pressure bar member is connected to a nut to prevent accidental separation thereof.

Furthermore, connection options are limited for conventional split bolt electrical connectors. Accordingly, a need exists for a split bolt electrical connector assembly having increased connection options.

SUMMARY OF THE INVENTION

An object of the present invention is to provide an improved, multi-purpose split bolt electrical connector assembly.

Another object of the present invention is to provide a split bolt electrical connector assembly having a plurality of connection options.

Another object of the present invention is to provide a split bolt electrical connector assembly in which a nut is axially fixed and rotatable with respect to a pressure bar member.

Another object of the present invention is to provide a split bolt electrical connector assembly in which a spacer has a removable connecting portion for connecting to a support.

The foregoing objectives are basically attained by an electrical connector includes a split bolt having a base and first and second legs extending outwardly therefrom. A conductor receiving channel is formed between the first and second legs. A nut threadably engages the first and second legs and has upper and lower surfaces and an opening therein. A pressure bar member is movably received in the conductor receiving channel. A head of the pressure bar member contacts the lower surface of the nut and a body of the pressure bar member extends through the opening in the nut. A spacer is disposed in the conductor receiving channel between the base and the head of the pressure bar member.

The foregoing objectives are also basically attained by an electrical connecting including a split bolt having a base and first and second legs extending outwardly therefrom. A conductor receiving channel is formed between the first and second legs. A nut threadably engages the first and second legs and has upper and lower surfaces and an opening therein. A pressure bar member is movably received in the conductor receiving channel. A spacer has a first portion disposed in the conductor receiving channel between the base and the head of the pressure bar member and a second portion disposed externally of the conductor receiving channel for connecting to a support.

The foregoing objectives are also basically attained by an electrical connector including a split bolt having a base and first and second legs extending outwardly therefrom. A conductor receiving channel is formed between the first and second legs. A pressure bar member is movably received in the conductor receiving channel. A nut threadably engages the first and second legs. The nut is axially fixed and rotatable with respect to the pressure bar member such that rotation of the nut in either direction results in corresponding axial movement of the pressure bar member.

Objects, advantages, and salient features of the invention will become apparent from the following detailed description, which, taken in conjunction with the annexed drawings, discloses an exemplary embodiment of the present invention.

As used in this application, the terms "front," "rear," "upper," "lower," "upwardly," "downwardly," and other orientational descriptors are intended to facilitate the description of the exemplary embodiments of the present invention, and are not intended to limit the structure thereof to any particular position or orientation.

BRIEF DESCRIPTION OF THE DRAWINGS

The above benefits and other advantages of the various embodiments of the present invention will be more apparent from the following detailed description of exemplary embodiments of the present invention and from the accompanying drawing figures, in which.

Throughout the drawings, like reference numerals will be understood to refer to like parts, components and structures.

DETAILED DESCRIPTION OF EXEMPLARY EMBODIMENTS

Figure 1:
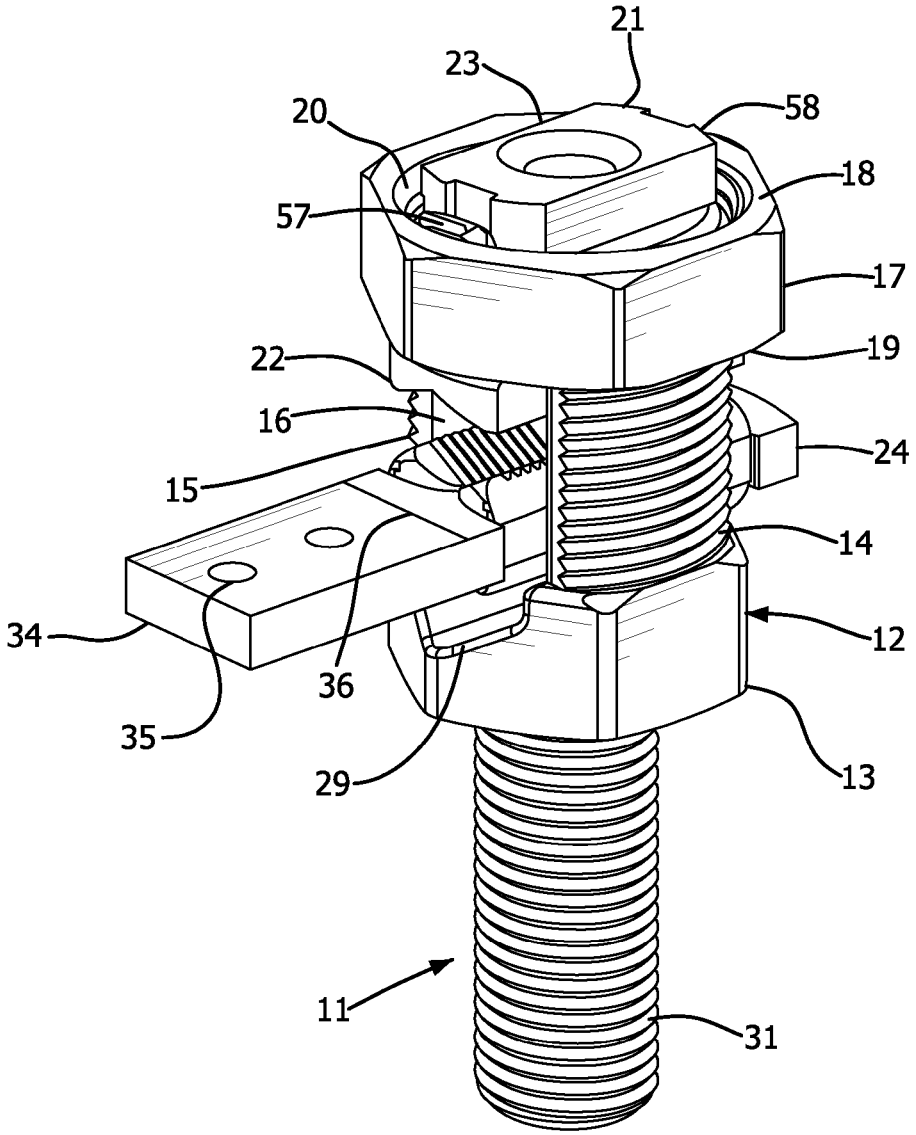
FIG. 1 is a perspective view of an split bolt electrical connector assembly in accordance with a first exemplary embodiment of the present invention.

The electrical connector assembly 11 includes a split bolt 12 having a base 13 and first and second legs 14 and 15 extending outwardly therefrom, as shown in FIGS. 1 and 12-14. A conductor receiving channel 16 is formed between the first and second legs 14 and 15, as shown in FIG. 2. A nut 17 threadably engages the first and second legs 14 and 15 and has upper and lower surfaces 18 and 19 and an opening 20 therein. A pressure bar member 21 is movably received in the conductor receiving channel 16. A head 22 of the pressure bar member 21 contacts the lower surface 19 of the nut 17. A body 23 of the pressure bar member 21 extends through the opening 20 in the nut 17. A spacer 24 is disposed in the conductor receiving channel 16 between the base 13 and the head 22 of the pressure bar member 21.

The split bolt 12, as shown in FIG. 2, includes first and second legs 14 and 15 extending upwardly from the base 13. The first leg 14 has a rounded outer surface 25 and an inner surface 26. The second leg 15 has a rounded outer surface 27 and an inner surface 28. The rounded outer surfaces 25 and 27 are threaded to receive and threadably engage the nut 17. The inner surfaces 26 and 28 are substantially planar and smooth. The inner surfaces 26 and 28 and the base 13 define the conductor receiving channel 16. A substantially V-shaped groove 29 in an upper surface 30 of the base 13 facilitates receiving a conductor. The substantially V-shaped groove 29 can be serrated to facilitate gripping a received conductor.

A threaded post 31 extends downwardly from a lower surface 32 of the base 13 of the split bolt 12. The threaded post 31 extends in a direction substantially opposite to the direction in which the first and second legs 14 and 15 extend. The threaded post 31 facilitates connecting the split bolt connector assembly 11 to a support, such as a steel plate having a fastener opening.

Figure 3:
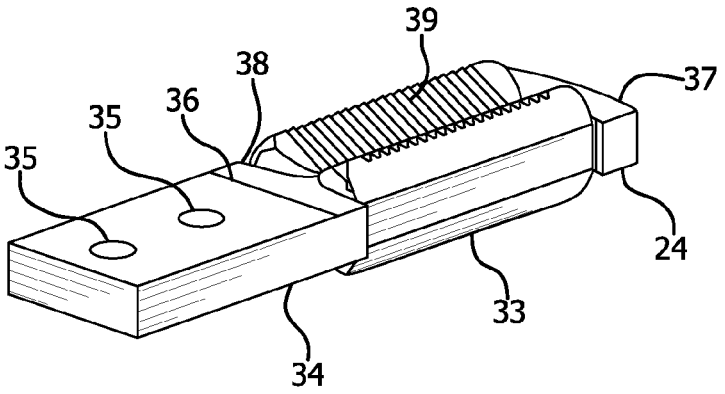
FIG. 3 is a perspective view of a spacer of the electrical connector assembly of FIG. 1.

The spacer 24, as shown in FIGS. 3 and 6-8, has a first portion 33 and a second portion 34. The first portion 33 of the spacer 24 is disposed in the conductor receiving channel 16, as shown in FIGS. 1 and 12-14. The second, or connecting, portion 34 is preferably substantially planar and is adapted to connect the electrical connector assembly 11 to a support. The second portion 34 may be a blank tongue (FIG. 4), a blank tongue with guide holes, or have at least one fastener hole 35 as shown in FIG. 3. The guide holes facilitate drilling the holes in the field. The at least one fastener hole 35 is adapted to receive a fastener to secure the electrical connector assembly 11 to a support. The second portion 34 is preferably removable from the first portion 33. A score line 36 can be disposed in the second portion 34 to facilitate removing the second portion 34 when it is not required, although any suitable frangible section or other separation means can be used, for example, to separate the entire connecting portion 34 from the spacer 24 as shown in the exemplary embodiments of FIGS. 3-8.

Figure 7:
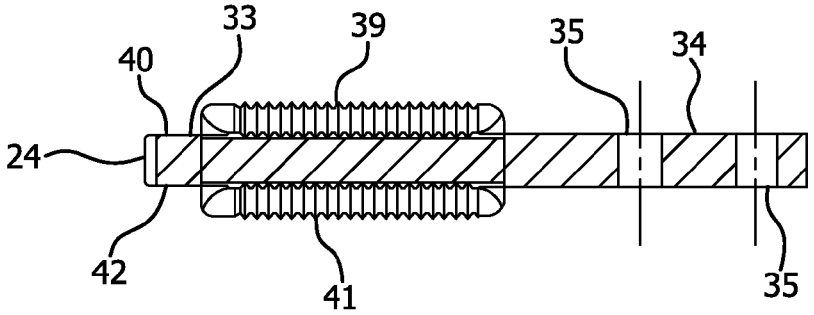
FIG. 7 is a side elevational view in cross section of the spacer taken along line 7-7 of FIG. 6.
Figure 8:
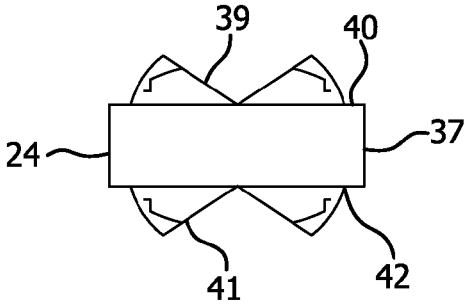
FIG. 8 is a front elevational view of the spacer of FIG. 6.
Figure 14:
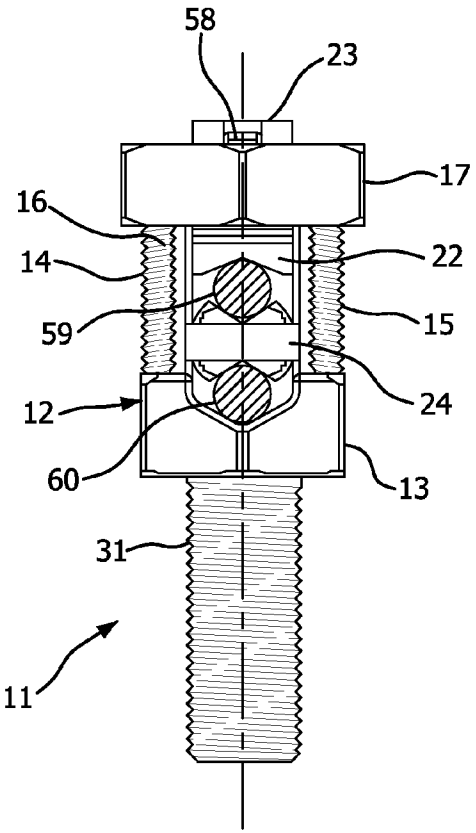
FIG. 14 is a front elevational view of the electrical connector assembly of FIG. 13.
Figure 13:
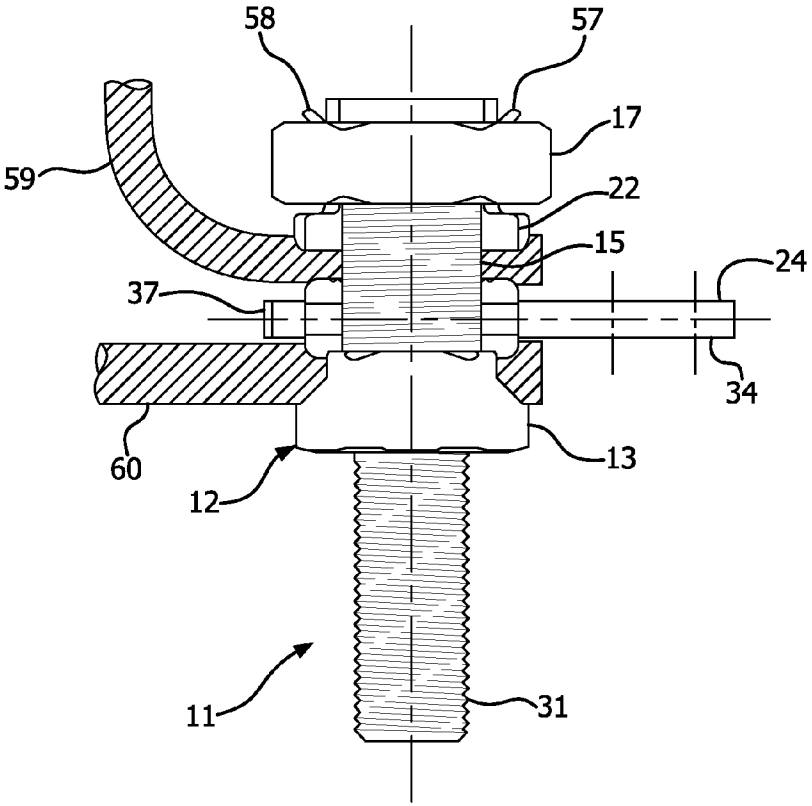
FIG. 13 is a side elevational view of the electrical connector assembly of FIG. 1 receiving conductors.

The spacer 24 has first and second enlarged portions 37 and 38 to prevent removal of the spacer from the conductor receiving channel 16, especially without holding the spacer. The widths of the first and second enlarged portions 37 and 38 of the spacer 24 are larger than a width of the conductor receiving channel 16 such that the spacer cannot be removed from the channel when the nut 17 and the pressure bar member 21 are connected to the legs 14 and 15 of the split bolt 12. A first substantially V-shaped groove 39 is formed in an upper surface 40 of the spacer 24 to facilitate receiving a first conductor 59 (FIGS. 13 and 14). A second substantially V-shaped groove 41 is formed in a lower surface 42 of the spacer 24, as shown in FIGS. 7 and 8, to facilitate receiving a second conductor 60 (FIGS. 13 and 14). The first and second substantially V-shaped grooves 39 and 41 are preferably serrated to facilitate gripping the received conductors 59 and 60.

Figure 4:
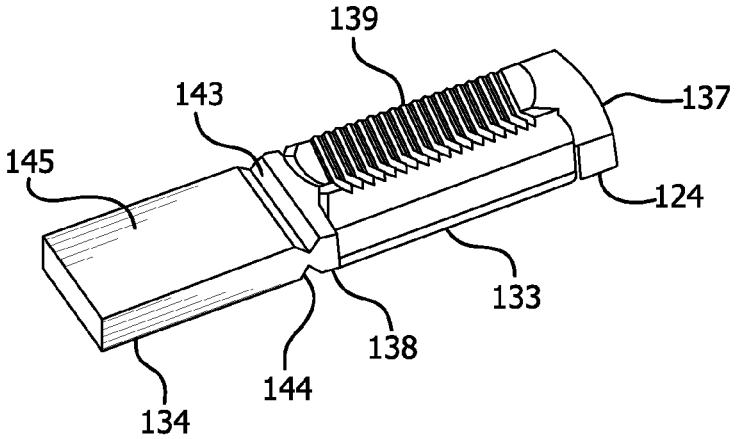
FIG. 4 is a perspective view of a spacer for the electrical connector assembly according to a second exemplary embodiment of the present invention.
Figure 5:
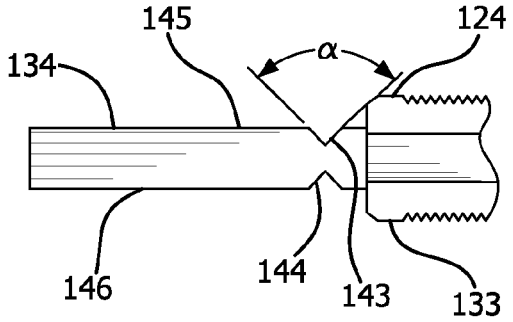
FIG. 5 is a partial side elevational view of the spacer of FIG. 4.
Figure 6:
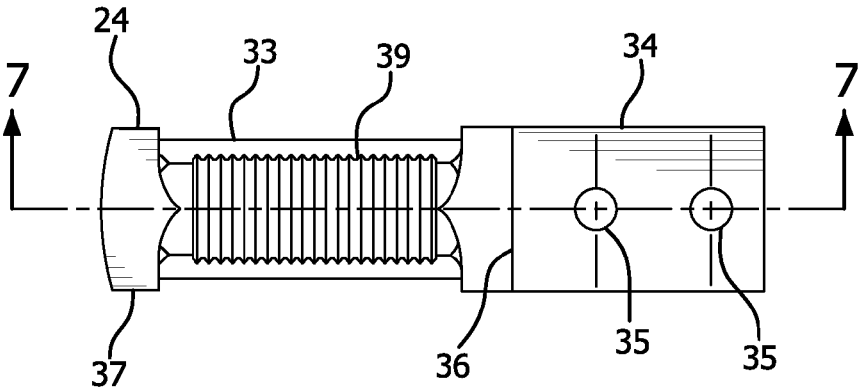
FIG. 6 is a top plan view of the spacer of FIG. 3.

In accordance with another exemplary embodiment of the present invention, an alternative spacer 124 is shown in FIGS. 4 and 5. The spacer 124 is substantially similar to the spacer 24 except for the following differences. Similar features are noted with the same reference number in the 1xx format or increased by 100. First and second notches 143 and 144 are disposed in upper and lower surfaces 145 and 146 of the second portion 134 of the spacer 124. The notches 143 and 144 facilitate separating the second portion 134 from the first portion 133 of the spacer 124 when the second portion is not required. The notches 143 and 144 have an angle $\alpha$ and a depth suitable to facilitate removing the second portion 134 from the first portion 133. Preferably, the angle $\alpha$ is approximately 90 degrees.

Figure 11:
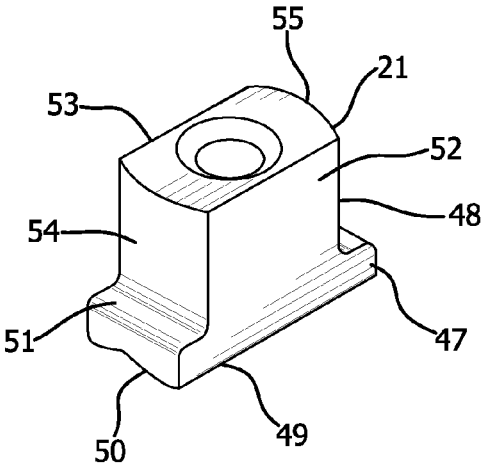
FIG. 11 is a perspective view of the pressure bar member of FIG. 9.

The pressure bar member 21 is shown in FIG. 11 prior to having the nut 17 connected thereto. The pressure bar member 21 includes a head 47 connected to a body 48. The head 47 preferably has a substantially rectangular shape. A lower surface 49 of the head 47 has a substantially V-shaped groove 50 to facilitate receiving a conductor. The substantially V-shaped groove is preferably serrated to facilitate gripping a received conductor.

The body 48 extends upwardly from an upper surface 51 of the head 47. The body 48 is preferably substantially rectangular and has a length less than that of the head 47, as shown in FIG. 11, which shows the pressure bar member prior to forming first and second protrusions 57 and 58. First and second opposite side surfaces 52 and 53 are substantially planar and smooth. Front and rear surfaces 54 and 55 of the body 48 are preferably rounded to correspond to an inner surface 56 of the nut 17.

Figure 9:
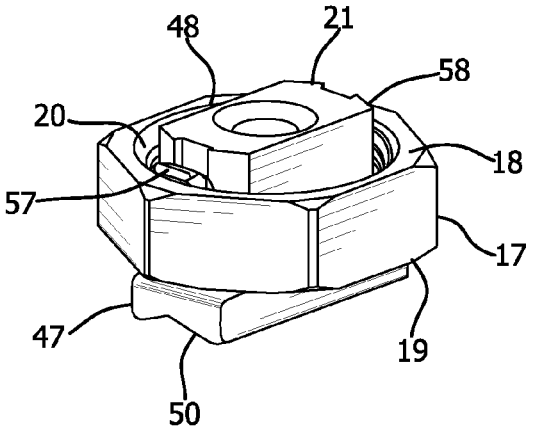
FIG. 9 is a perspective view of a nut and pressure bar member of the electrical connector assembly of FIG. 1.
Figure 10:
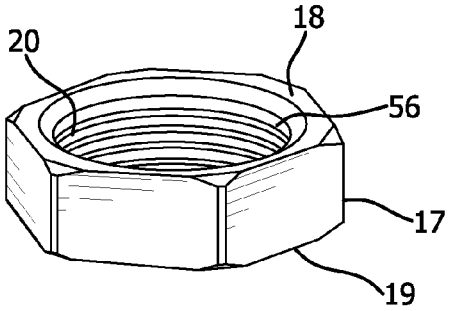
FIG. 10 is a perspective view of the nut of FIG. 9.

The nut 17 has upper and lower surfaces 18 and 19 and an opening 20 extending from the upper to the lower surface. The inner surface 56 of the nut 17 is threaded to engage the threads on the outer surfaces of the legs 14 and 15, as shown in FIG. 10. The lower surface 19 of the nut 17 contacts the upper surface 51 of the head 47 of the pressure bar member 21 when the nut 17 is disposed on the body 48 of the pressure bar member 21, as shown in FIG. 9. First and second protrusions 57 and 58 are formed in a surface of the body 48 of the pressure bar member 21 to prevent the nut 17 from being removed from the pressure bar member 21. The protrusions 57 and 58 can be formed in any suitable manner. For example, the protrusions can be formed by staking, in which material is displaced from the body 48 with a cutting tool until the protrusions exceed the diameter of the nut opening 20, thereby preventing the nut 17 from being removed from the pressure bar member 21. Preferably, the width of the protrusions 57 and 58 is between approximately 50 to 75% of a width of the pressure bar member, as shown in FIGS. 1, 9, 12 and 14, although any suitable width can be used. The diameter of the opening 20 in the nut 17 is less than the length of the lateral extent of the head 47 of the pressure bar member 21 to limit axial movement of the nut toward the head 47. The length from an end of the first protrusion 57 to an end of the second protrusion 58 is larger than the diameter of the nut opening 20, thereby limiting axial movement of the nut 17 in a direction away from the head 47. Accordingly, the nut 17 is axially fixed between the first and second protrusions 57 and 58 on the upper surface 18 and the head 47 on the lower surface 19. The nut 17 is axially fixed and rotatable with respect to the pressure bar member 21.

The split bolt 12, nut 17, pressure bar member 21 and the spacer 24 are preferably made of metal, such as a copper alloy.

Assembly and Operation

Figure 2:
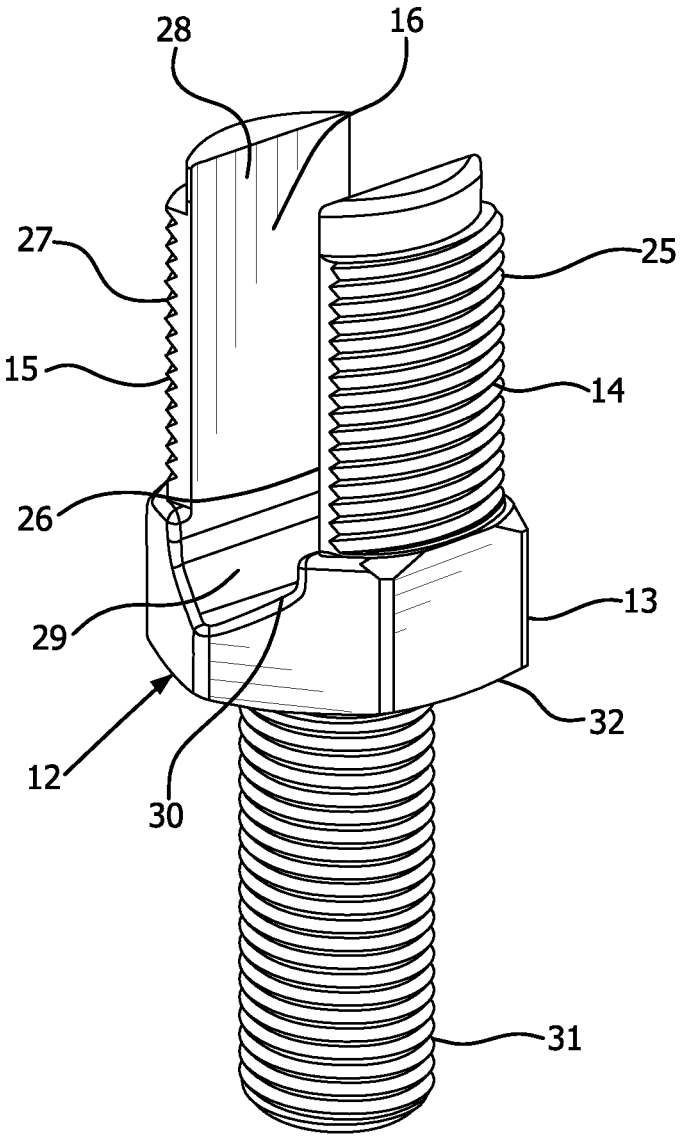
FIG. 2 is a perspective view of a split bolt of the electrical connector assembly of FIG. 1.

The split bolt electrical connector assembly 11 is shown assembled in FIG. 1. A spacer bar 24 (FIG. 3) is disposed in the conductor receiving channel 16 of a split bolt connector 12 (FIG. 2) from the open end of channel 16. The assembly of the nut 17 and pressure bar member 21 are then threaded onto the first and second legs 14 and 15. The enlarged portions 37 and 38 of the spacer 24 prevent the spacer 24 from being withdrawn from the conductor receiving channel 16. The nut 17 prevents the spacer 24 from being withdrawn in an upward direction. The spacer 24 is not required when only a single conductor is connected to the electrical connector assembly.

The nut 17 and pressure bar member 21 are connected prior to being connected to the split bolt connector 12. The nut 17 is disposed on the body 23 of the pressure bar member 21. First and second protrusions 57 and 58 are formed from the body 23 of the pressure bar member 21, such that the length between opposite ends of the protrusions 57 and 58 is larger than the diameter of nut opening 20. Thus, the nut 17 is axially fixed with respect to the pressure bar member 21, while being rotatable with respect to the pressure bar member 21.

Figure 12:
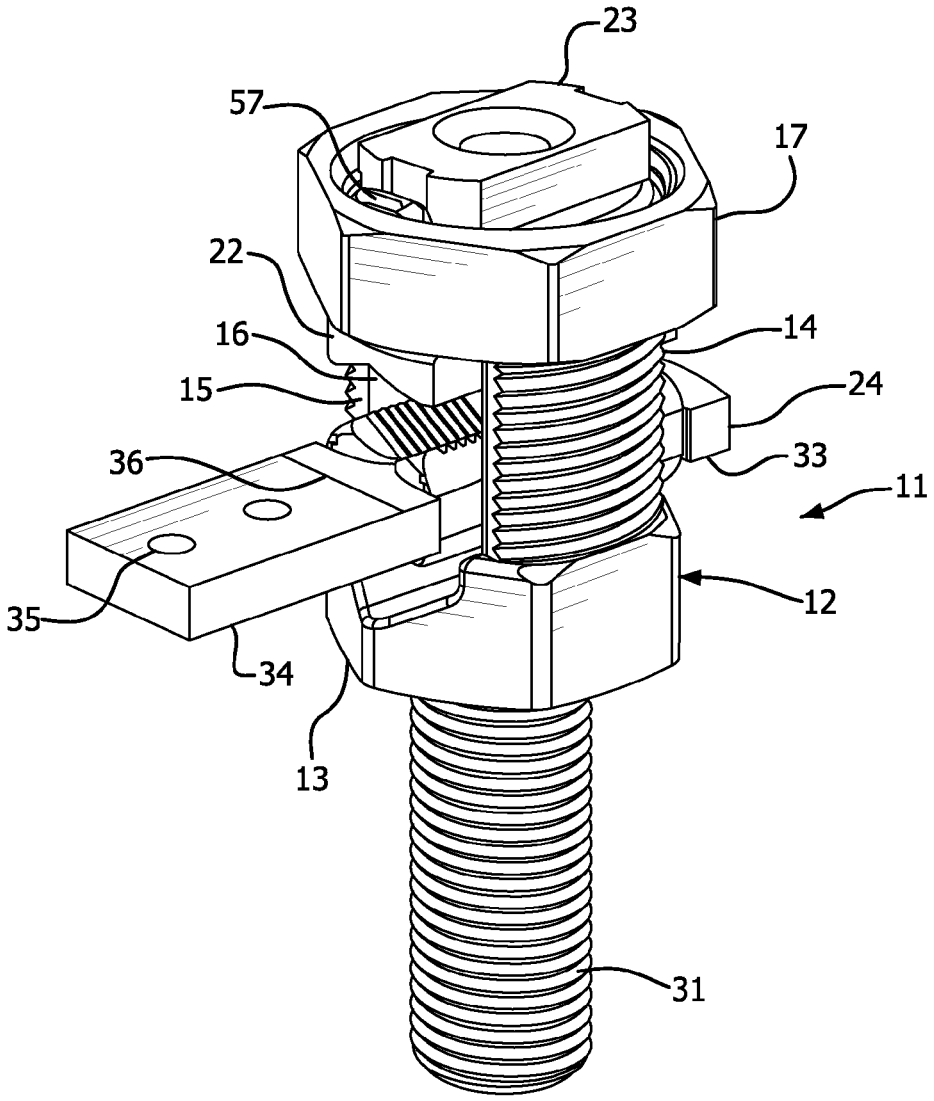
FIG. 12 is a perspective view of the electrical connector assembly of FIG. 1 in which the nut and pressure bar member have been moved downwardly on legs of the split bolt.

As shown in FIG. 12, the nut 17 is rotated clockwise to move the head 22 of the pressure bar member 21 downwardly in the conductor receiving channel 16. A first conductor 59 is disposed between the head 22 of the pressure bar member 21 and the upper surface 40 of the spacer 24, as shown in FIGS. 13 and 14. The first conductor 59 is securely retained in the substantially V-shaped grooves 50 and 39 in the head 47 of the pressure bar member 21 and the spacer 24, respectively. A second conductor 60 is disposed between the lower surface 42 of the spacer 24 and the base 13 of the split bolt 12. The second conductor 60 is securely retained in the substantially V-shaped grooves 41 and 29 in the spacer 24 and the base 13, respectively. Preferably, the substantially V-shaped grooves 29, 39, 41 and 50 are serrated to further facilitate gripping the conductors 59 and 60. The nut 17 is rotated clockwise to move the head 22 of the pressure bar member 21 downwardly in the conductor receiving channel 16, thereby tightening the grip on the first and second conductors 59 and 60. Rotating the nut 17 counterclockwise causes the pressure bar member 21 to move upwardly through the conductor receiving channel 16 such that the conductors 59 and 60 can be removed.

The electrical connector assembly 11 can be secured to a support by inserting fasteners through the fastener holes 35 in the spacer 24. Alternatively, the threaded post 31 can be used to secure the electrical connector assembly 11 to the support. When the second portion 34 of the spacer 24 is not required, the second portion 34 can be removed from the first portion 33 without affecting the conductor receiving ability of the spacer 24.

The foregoing embodiments and advantages are merely exemplary and are not to be construed as limiting the scope of the present invention. The description of exemplary embodiments of the present invention is intended to be illustrative, and not to limit the scope of the present invention. Various modifications, alternatives and variations will be apparent to those of ordinary skill in the art, and are intended to fall within the scope of the invention as defined in the appended claims and their equivalents.

What is claimed is:

1. An electrical connector, comprising:

a split bolt having a base and first and second legs extending outwardly therefrom, a conductor receiving channel being formed between said first and second legs;

a nut threadably engaging said first and second legs and having upper and lower surfaces and an opening therein;

a pressure bar member movably received in said conductor receiving channel, a head of said pressure bar member contacting said lower surface of said nut and a body of said pressure bar member extending through said opening in said nut; and a spacer disposed in said conductor receiving channel between said base and said head of said pressure bar member, said spacer having a first enlarged portion wider than said conductor receiving channel and a second enlarged portion wider that said conductor receiving channel, and a removable substantially planar connecting portion extending outwardly from said first enlarged portion, said connecting portion having a dimension and configuration for connecting and securing said electrical connector to a support for supporting said connector, and where said connecting portion has at least one hole with a dimension for receiving a fastener for securing said electrical connector to said support, and a frangible portion between said connecting portion and said first enlarged portion for separating said connecting portion.

2. The electrical connector according to claim 1, wherein a threaded post extends from said base in a direction substantially opposite to said first and second legs.

3. The electrical connector according to claim 1, wherein said body extends through said nut and has at least one outwardly extending protrusion cut from said body to prevent axial movement of said nut in a direction away from said head of said pressure bar member.

4. The electrical connector according to claim 3, wherein said nut is axially fixed and rotatable with respect to said pressure bar member.

5. The electrical connector according to claim 1, wherein each of said upper and lower surfaces of said spacer has a substantially V-shaped groove to facilitate receiving a conductor.

6. The electrical connector according to claim 1, wherein said base has a substantially V-shaped groove to facilitate receiving a conductor.

7. An electrical connector, comprising:

a split bolt having a base and first and second parallel and externally threaded legs extending outwardly therefrom at a first end, a conductor receiving channel being formed between said first and second legs;

a threaded post extending from said base at a second end in a direction substantially opposite to said first and second legs and configured tired for mounting said electrical connector to a support;

a nut threadably engaging said first and second legs and having upper and lower surfaces and an opening therein;

a pressure bar member having a head contacting a lower surface of said nut and a body extending through said nut and movably received in said conductor receiving channel, said body having an upper surface, substantially planar opposite side surfaces, and rounded opposite end surfaces, said rounded surfaces having a cut portion that is bent outward to form protrusions to engage the upper surface of the nut; and a spacer having a first portion disposed in said conductor receiving channel between said base and said head of said pressure bar member and a second portion extending outwardly from said first portion and externally of said conductor receiving channel, a removable planar connecting portion extending from said second portion with a dimension for attaching and connecting to a support and having a first guide hole and a second guide hole.

8. The electrical connector according to claim 7, wherein said protrusions are spaced from said axial end of said body to prevent axial movement of said nut in a direction away from said head of said pressure bar member.

9. The electrical connector according to claim 8, wherein said nut is axially fixed and rotatable with respect to said pressure bar member.

10. An electrical connector, comprising:

a split bolt having a base and first and second parallel and externally threaded legs extending outwardly therefrom, a conductor receiving channel being formed with a first width between said first and second legs;

a pressure bar member movably received in said conductor receiving channel;

a nut threadably engaging said first and second legs, said nut being axially fixed and rotatable with respect to said pressure bar member such that rotation of said nut in either direction results in corresponding axial movement of said pressure bar member; and a spacer having a first portion with a first width disposed in said conductor receiving channel between said base and said pressure bar member, an enlarged portion having a second width greater than said first width of said spacer, and a removable connecting portion extending outwardly from said enlarged portion and outwardly from said split bolt, said connecting portion having a frangible section between said enlarged portion and said connecting portion, said connecting portion having at least one hole for receiving a fastener and having a dimension for securing said connector to a support by the fastener for supporting said connector.

11. The electrical connector according to claim 10, wherein a threaded post extends from said base in a direction substantially opposite to said first and second legs.

12. The electrical connector according to claim 1, wherein said connecting portion of said spacer is a blank tongue.

13. The electrical connector according to claim 10, wherein said connecting portion has a length adapted for coupling to a connector and has a first fastener hole.

14. The electrical connector according to claim 13, wherein said connecting portion has a second fastener hole and said frangible section is positioned between said first and second fastener holes and said enlarged portion.

15. The electrical connector according to claim 7, wherein said spacer includes an enlarged portion having a width greater than a width of said conductor receiving channel, and said connecting portion has a frangible section formed by notches on opposite sides of said connecting portion and positioned between said enlarged portion and said first guide hole.

16. The electrical connector according to claim 3, wherein said protrusion extends outwardly from a side wall of said body of said pressure bar and is spaced from an axial end of said body of said pressure bar.

17. The electrical connector according to claim 16, wherein said body of said pressure bar has an axial end extending through said nut; and said protrusion is spaced from said axial end of the body of the pressure bar.

* * * * *